United States Patent [19]

Connell

[11] 3,966,243

[45] June 29, 1976

[54] SECURITY BAR ASSEMBLY FOR DOUBLE DOORS

[76] Inventor: Robert I. Connell, 896 S. Main St., Mount Holly, N.C. 28120

[22] Filed: July 23, 1975

[21] Appl. No.: 598,201

[52] U.S. Cl. ..... 292/40

[51] Int. Cl.[2] ..... E05C 7/04

[58] Field of Search ..... 292/40, 42, 36, 259, 292/260, 33, 66

[56] References Cited

UNITED STATES PATENTS

| | | | |
|---|---|---|---|
| 596,050 | 12/1897 | Byrnes | 292/40 X |
| 1,077,433 | 11/1913 | Schlis | 292/40 |

FOREIGN PATENTS OR APPLICATIONS

| | | | |
|---|---|---|---|
| 7,182 | 5/1888 | United Kingdom | 292/40 |

*Primary Examiner*—Richard E. Moore
*Attorney, Agent, or Firm*—Bell, Seltzer, Park & Gibson

[57] ABSTRACT

A security lock device for a side-by-side pair of hinged double doors which permits securely locking the doors to the opposing door jambs and to one another to thereby secure the same against forced entry. The security lock device comprises a pair of locking bar assemblies mounted on a common face of the pair of doors and extending generally horizontally thereacross. Each locking bar assembly includes an elongate central mounting bar extending widthwise of the door with a pair of slidable bars mounted along opposite sides of the central mounting bar and adapted for longitudinal sliding movement between a retracted unlocked position and an extended locked position. When in the extended locked position, the slidable bars interlockingly engage one another at the opposing inside edges of the doors where the doors meet and also engage the door jambs along the outside edges of the door to thereby maintain the pair of double doors in a tightly locked position.

9 Claims, 4 Drawing Figures

SECURITY BAR ASSEMBLY FOR DOUBLE DOORS

The present invention relates to a security bar arrangement for securing side-by-side hinged double doors, such as the type of doors commonly provided at the side or rear of stores or other commercial or industrial establishments.

Since such rear and side doors are usually well concealed, they are often forced or "jimmied" by burglars to gain entry to the building. Thus, the need exists for a strong and efficient means for securing such double doors against forced entry. One securement method which has been commonly employed for doors of this type involves placing a long bar across the width of the doorway with brackets being provided on the doors and on the walls adjacent the doors for supporting the bar in position. However, this type of locking arrangement is cumbersome and generally requires a relatively strong person to position the bar across the doors each night and to remove the bar upon opening the doors in the morning.

With the foregoing in mind, it is an object of the present invention to provide a more efficient means for securing a pair of hinged double doors against forced entry.

More particularly, it is an object of this invention to provide a security lock device which may be easily installed on a pair of hinged double doors and which may be easily locked and unlocked without requiring the removal or storage of any parts.

It is a more specific object of this invention to provide a security lock device of the type described wherein a pair of locking bar assemblies are mounted to a common face of the pair of side-by-side hinged double doors extending generally horizontally thereacross, and which are operable to permit lockingly securing the doors to the opposing door jambs and to one another.

More particularly, each locking bar assembly includes an elongate central mounting bar which may be easily secured to the face of the door extending widthwise thereof and to which all the other parts of the locking bar assembly are mounted. The entire assembly may be previously assemblied and easily installed on a door by bolts, welding or other suitable means.

The locking bar assembly also includes an outer elongate slidable bar positioned alongside one side of the elongate central mounting bar and adapted for sliding movement longitudinally therealong to position one end portion of the slidable bar outwardly beyond the outside end of the central bar and beyond the outside edge of the door for engaging with the vertically extending door jamb to which the door is hinged. The bar assembly additionally includes an inner elongate slidable bar positioned alongside the opposite side of the central mounting bar and adapted for sliding movement longitudinally therealong to position one end portion of the slidable bar inwardly beyond the inside end of the central bar and beyond the inside edge of the door for engagement with the adjacent door. A crank arm pivotally innerconnects the inner and outer slidable bars so as to effect simultaneous longitudinal sliding movement of the two slidable bars toward or away from each other between a retracted unlocked position and an extended locked position.

Thus, when the locking bar assemblies on the respective doors are in the extended locked position, the inner slidable bars thereof interlockingly engage with the adjacent locking bar assembly at the opposing inside edges of the doors where the doors meet, while the outer slidable bars engage the opposing door jambs.

In accordance with one embodiment of the invention, hasp means are provided on each of the locking bar assemblies for receiving a padlock therethrough to secure each locking bar assembly in the extended locked position.

Pursuant to a second embodiment of the invention, hasp means is provided on one of the locking bar assemblies for receiving a padlock therethrough, and means is provided on the other bar assembly to prevent the same from being moved to a retracted unlocked position so long as the padlocked locking bar assembly is in the extended locked position. Thus, a single padlock may be employed for securing both locking bar assemblies.

Some of the objects and features of the invention having been stated, other objects and features of the invention will become apparent from the following detailed description of the invention and accompanying drawings, in which.

Figures 1, 2, 3, 4:
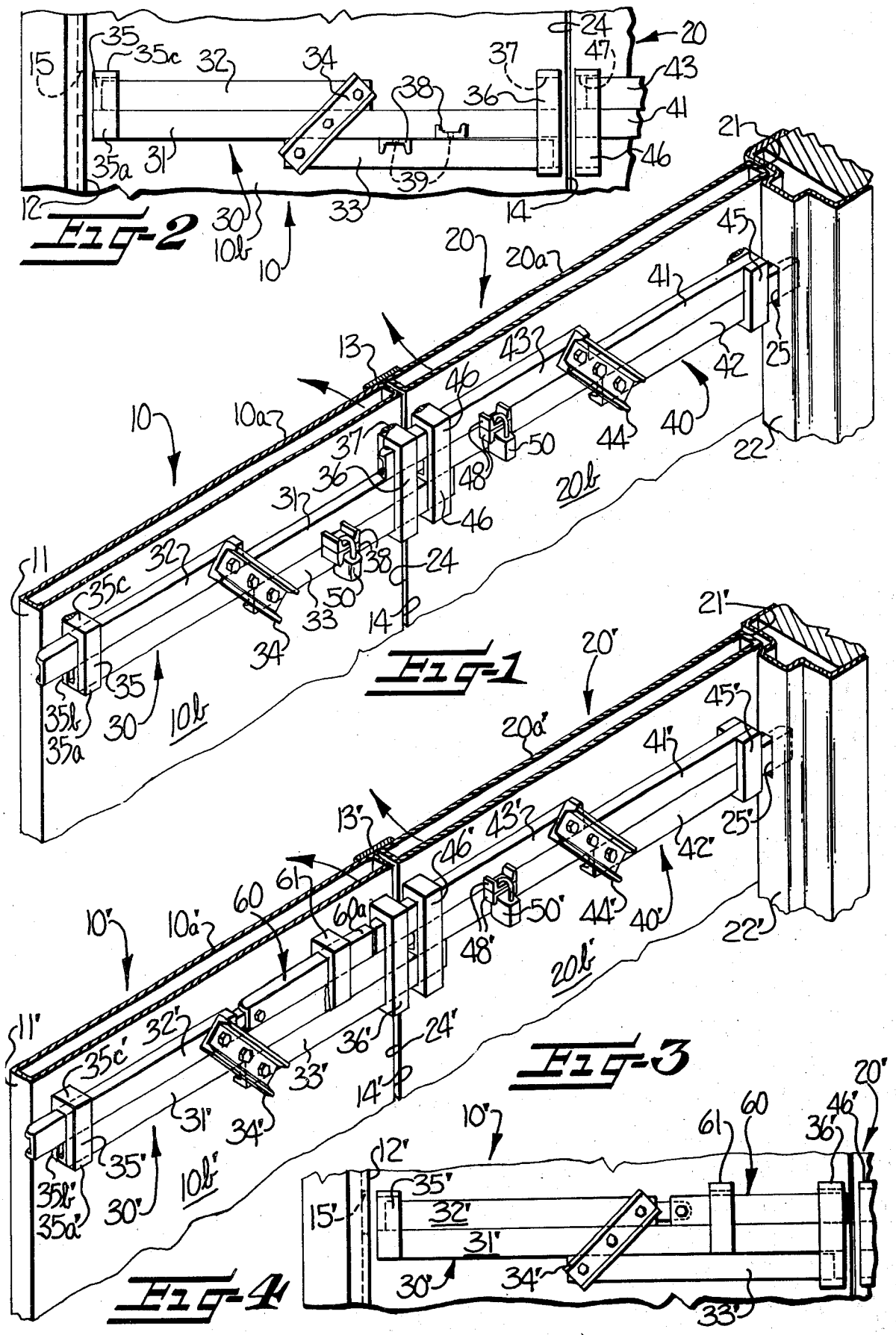
FIG. 1 is a fragmentary perspective view of a pair of hinged double doors employing a security locking device in accordance with a first embodiment of the invention, and shown in the locked position.
FIG. 2 is a detailed elevational view of the portion of the locking device shown on the left hand side of FIG. 1, but shown in the unlocked position.
FIG. 3 is a fragmentary perspective view similar to FIG. 1, but showing a second embodiment of the invention.
FIG. 4 is a detailed elevational view of the portion of the locking device shown on the left hand side of FIG. 3, but shown in the unlocked position.

Referring more particularly to the drawings, FIG. 1 illustrates a side-by-side pair of hinged double doors, including a primary or active door 10 which is normally opened for ingress and egress, and a secondary or inactive door 20 which is normally maintained in a closed position by suitable dead bolts, not shown, but which may be opened when needed to accommodate large objects through the doorway. The doors 10, 20 are hinged along thier respective outside edges 11, 21 to opposing vertically extending door jambs 12, 22 which define the doorway opening. A plate 13 is mounted to the outer face **10*a* of the primary door 10 so as to overlap the opposing inside edges 14, 24** of the doors.

On the inside face **10*b*, 20*b* of each door 10, 20 is mounted a locking bar assembly, generally designated at 30 and 40. Referring more particularly to the left hand illustrated locking bar assembly 30 for purposes of explanation, it will be seen that the bar assembly includes an elongate central mounting bar 31 of a length substantially corresponding to the width of the door 10 and which is mounted extending generally horizontally widthwise of the door. Central mounting bar 31 is secured to door 10** by any suitable means such as by bolts extending through the door, or as illustrated, by welding.

Positioned alongside the central mounting bar 31 are a pair of slidable bar members designated at 32 and 33 respectively. As illustrated, slidable bar members 32 and 33 are of substantially shorter length than central bar 31, preferably about one-half the length of central bar 31 and are preferably formed of a U-shaped cross-section steel bar stock. Slidable bar 32 is positioned alongside the upper surface of the central mounting bar 31 and is adapted for longitudinal sliding movement with respect thereto so as to position one end of the slidable bar 32 outwardly beyond the end of the central bar 31 and beyond the outer edge of door 11 so as to be received in a hole 15 provided in door jamb 12. The inner slidable bar 33 is positioned extending alongside the lower surface of central bar 31 and is adapted for longitudinal sliding movement so as to position one end portion of the slidable bar 33 outwardly beyond the inner end of the central bar 31 and the inner edge 14 of door 10 so as to engage with the locking bar assembly 40 of the other door 20. A crank arm 34 is pivotally connected to an end portion of each of the slidable bars 32, 33 and to the middle portion of central bar 31 and effects simultaneous movement of the slidable bars 32, 33 toward and away from each other between a retracted unlocked position and an extended locked position.

A keeper 35 is provided at the outer end of central bar 31 and surroundingly engages the outer slidable bar 32 so as to permit longitudinal sliding movement therethrough while retaining the slidable bar in position alongside the central bar 31. As illustrated, keeper 35 comprises a pair of bar members 35*a*, 35*b* welded on opposite sides of central bar 31 with a cap 35*c* extending therebetween and defining an opening through which bar 32 may extend. A keeper 36 is similarly provided at the opposite or inner end of the central bar 31. As illustrated, the keeper 36 is mounted so as to loosely surroundingly engage the inner slidable bar 33 and retain the same in position alongside the lower surface of central bar 31. Means is also provided at the inner end of central bar 31 defining an opening 37 for receiving and engaging with the protruding end portion of the inner slidable bar 43 on the opposite bar assembly 40. As illustrated, this means is formed integral with keeper 36 and extends upwardly above the central bar 31 to define an opening 37 through which the inner slidable bar 43 on the opposite door may extend so as to lockingly engage the doors together.

In order to retain the locking bar assemblies in an extended locked position, hasp means in the form of a pair of opposing lugs 38 are provided respectively on the central mounting bar 31 and on one of the slidable bars 33, with the lugs 38 having holes 39 therethrough through which a padlock 50 may be positioned to lock the locking bar assembly 30 in an extended locked position.

The elements of the locking bar assembly 40 on the other door 20 correspond essentially to those previously described with respect to the sliding bar assembly 30, with the exception that the outer slidable bar 42 extends alongside the lower surface of the central mounting bar 41 and the inner slidable bar 43 extends alongside the upper surface of the central bar 41. To avoid repetition, the elements of bar assembly 40 will not be described in detail, but it will be noted that corresponding reference characters have been employed to identify corresponding elements on the respective bar assemblies 30 and 40.

Thus, it will be seen that the pair of locking bar assemblies 30, 40 when in the locked position, have their inner slidable bars 33, 43 interlockingly engaging one another at the opposing inside edges of the doors 14, 24 with the end portion of the slidable bar 33 extending through the opening 47 provided in the keeper 46 of the bar assembly 40, and with the slidable bar 43 being positioned in the opening 37 of the bar assembly 30.

A second embodiment of the invention is illustrated in FIGS. 3 and 4. Pursuant to this embodiment of the invention the pair of locking bar assemblies may be secured in an extended locked position by a single padlock. Since the structure of this embodiment of the invention is very similar to the previously described embodiment, to avoid repetitive description only the parts which differ over the previously described structure will be described in detail, with the remaining similar parts being identified by the same reference characters as the previous embodiment, but with prime notation added.

Referring more particularly to FIGS. 3 and 4, it will be seen that the hasp means and padlock 50′ is provided only on the right hand locking bar assembly 40′. On the other bar assembly 30, an elongate slidable locking member or bar 60 is connected to the outer slidable bar 32′ and extends inwardly toward the inner end of central bar 31′. Preferably, this locking bar 60 is pivotally connected to the slidable bar 32′ to permit complete freedom of movement when the bar is moved between locked and unlocked positions. A keeper 61 carried by the central bar 31′ surroundingly engages the locking member 60 and retains the same in position alongside the upper surface of the central mounting bar 31′.

Referring more particularly to FIG. 3, it will be seen that when both locking bar assemblies 30′ and 40′ are in the locked position, the inner end portion of inner slidable bar 43′ and the end portion 60*a* of the locking member 60 are in closely adjacent opposing relation. Thus, the member 60 prevents the bar assembly 30′ from being moved to an unlocked position so long as the bar assembly 40′ is in the locked position. Referring to FIG. 4, it will be seen that when bar assembly 40′ is in the unlocked position and inner slidable bar 43 is retracted, then the bar assembly 30′ may also be moved to the unlocked position.

Thus it will be seen that this embodiment of the invention conveniently permits maintaining both of the locking bar assemblies 30′, 40′ in a secured locked position by means of a single padlock 50′.

In the drawings and specification, there has been set forth preferred embodiments of the invention, and although specific terms are employed, they are used in a generic and descriptive sense only and not for purposes of limitation.

That which is claimed is:

1. A security lock device for a side-by-side pair of hinged double doors comprising a pair of locking bar assemblies adapted to be mounted respectively on a common face of the pair of doors extending generally horizontally thereacross and being operable to permit lockingly securing the doors to the opposing door jambs and to one another, each locking bar assembly including an elongate central mounting bar adapted for being securely mounted on the face of the door extending widthwise thereof with one end of the central mounting bar positioned adjacent the outside edge of the door and adjacent the door jamb and with the other end thereof positioned adjacent the inside edge of the door where the doors meet, a relatively short crank member pivotally connected to said central bar and having opposite end portions thereof extending on opposite sides of the pivotal connection with said central bar, an outer elongate slidable bar positioned alongside said elongate central mounting bar and pivotally connected to one of said end portions of said crank member and being slidably movable longitudinally along said central bar to position a free end portion of the outer slidable bar outwardly beyond the outside end of the central bar and beyond the outside edge of the door for engaging with the adjacent door jamb, an inner elongate slidable bar also positioned alongside said central mounting bar and pivotally connected to the other end portion of said crank member, said inner slidable bar thereby being slidably movable longitudinally along said central bar simultaneously with and in the opposite direction to said outer slidable bar to position a free end portion of the slidable bar inwardly beyond the inside end of the central bar and beyond the inside edge of the door for engagement with the adjacent other door, keeper means carried by said central bar adjacent each end thereof and cooperating with the respective outer and inner slidable bars for retaining said slidable bars in position alongside the central bar while permitting longitudinal sliding movement thereof, and means carried by said central bar adjacent the inside end thereof for receiving and lockingly engaging with the extended free end portion of the inner sliding bar on the opposite door so that said pair of locking bar assemblies, when in the extended locked position, interlockingly engage one another at the opposing inside edges of the doors where the doors meet and also engage the door jambs along the outside edges of the doors to thereby maintain the pair of double doors in tightly locked position.

2. A security lock device according to claim 1 wherein said outer and inner slidable bars are of considerably shorter length than said elongate central mounting bar and are positioned alongside the upper and lower side surfaces of the horizontally extending central mounting bar.

3. A security lock device according to claim 2 wherein said crank arm is pivotally connected to said elongate central mounting bar adjacent the midpoint of the length thereof and is pivotally connected to said inner and outer elongate slidable bars adjacent the end portions thereof opposite from said free end portions thereof.

4. A security lock device according to claim 3 wherein said pair of locking bar assemblies have the respective slidable bars thereof positioned at corresponding locations thereon so that the uppermost slidable bars of the pair of bar assemblies extend commonly in one direction and respectively engage one door jamb and its adjacent door, and so that the lowermost slidable bars of the pair of bar assemblies extend commonly in the opposite direction and respectively engage the opposite door jamb and its adjacent door.

5. A security lock device according to claim 1 including hasp means carried by each of said locking bar assemblies and each being adapted for receiving a padlock therethrough for maintaining the respective bar assembly in an extended locked position.

6. A security lock device according to claim 1 including hasp means carried by one of said locking bar assemblies and being adapted for receiving a padlock therethrough for maintaining the bar assembly in an extended locked position, and means associated with the other of said locking bar assemblies and cooperating with said one padlocked locking bar assembly for preventing said other locking bar assembly from being moved to the unlocked position while said one padlocked bar assembly is in the extended locked position to thereby permit maintaining both of said bar assemblies in an extended locked position with the use of a single padlock.

7. A security lock device according to claim 6 wherein said last recited means comprises an elongate slidable locking member connected to and extending inwardly from the outer slidable bar of said other locking bar assembly, said locking member being positioned in abutting engagement with the protruding end portion of the inner elongate slidable bar of said one locking bar assembly when both of said locking bar assemblies are in the extended locked position and thereby serving to prevent said other locking bar assembly from being moved to the unlocked position while said one locking bar assembly is in the extended locked position.

8. In a side-by-side pair of double doors hingedly connected along their respective outside edges to opposing vertically extending door jambs and positioned with their inside edges in opposing relation, the combination therewith of a pair of locking bar assemblies mounted respectively on a common face of the pair of doors extending generally horizontally thereacross and operable for permitting lockingly securing the doors to the opposing door jambs and to one another, each locking bar assembly including an elongate central mounting bar mounted securely to the face of the door and extending widthwise thereof with one end of the central mounting bar positioned adjacent the outside edge of the door and adjacent the door jamb and with the other end thereof positioned adjacent the inside edge of the door where the doors meet, an outer elongate slidable bar positioned alongside one side of said elongate central mounting bar and being adapted for sliding movement longitudinally therealong to position one end portion of the slidable bar outwardly beyond the outside end of the central bar and beyond the outside edge of the door and into engagement with the adjacent door jamb, an inner elongate slidable bar positioned alongside the opposite side of said central mounting bar and being adapted for sliding movement longitudinally therealong in the opposite direction to position one end portion of the slidable bar inwardly beyond the inside end of the central bar and beyond the inside edge of the door and into engagement with the adjacent other door, a crank member pivotally connected to said central bar and to each of said inner and outer slidable bars and operable for effecting simultaneous longitudinal sliding movement of the two slidable bars toward or away from one another between a retracted unlocked position and an extended locked position, keeper means carried by said central bar adjacent each end thereof and cooperating with the respective outer and inner slidable bars for retaining said slidable bars in position alongside the central bar while permitting longitudinal sliding movement thereof, and means carried by said central bar adjacent the inside end thereof for receiving and lockingly engaging with the extended end portion of the inner sliding bar on the opposite door so that said pair of locking bar assemblies, when in the extended locked position, interlockingly engage one another at the opposing inside edges of the doors where the doors meet and also engage the door jambs along the outside edges of the doors to thereby maintain the pair of double doors in tightly locked position.

9. In a side-by-side pair of double doors hingedly connected along their respective outside edges to opposing vertically extending door jambs and positioned with their inside edges in opposing relation, the combination therewith of a pair of locking bar assemblies mounted respectively on a common face of the pair of doors extending generally horizontally thereacross and operable for permitting lockingly securing the doors to the opposing door jambs and to one another, each locking bar assembly including an elongate central mounting bar of a length substantially corresponding to the width of the door and mounted securely to the face of the door extending horizontally widthwise thereof with one end of the central mounting bar positioned adjacent the outside edge of the door and adjacent the door jamb and with the other end thereof positioned adjacent the inside edge of the door where the doors meet, a crank member pivotally connected to said central bar adjacent the midpoint of its length with opposite end portions of the crank member extending above and below the upper and lower side surfaces of the horizontally extending central bar, an outer elongate slidable bar of a length substantially less than that of said central bar positioned closely alongside one side surface of said elongate central mounting bar and being pivotally connected at one end portion thereof to one of said end portions of said crank member, said outer slidable bar being slidably movable longitudinally along said central bar to position the free end portion thereof outwardly beyond the outside end of the central bar and beyond the outside edge of the door and into engagement with the adjacent door jamb, an inner elongate slidable bar of a length substantially corresponding to said outer slidable bar and being positioned closely alongside the opposite side surface of said central mounting bar with one end portion thereof pivotally connected to the other end portion of said crank member, said inner slidable bar being slidably movable longitudinally along said central bar simultaneously with and in the opposite direction to said outer slidable bar to position the free end portion of the inner slidable bar inwardly beyond the inside end of the central bar and beyond the inside edge of the door and into engagement with the locking bar assembly of the adjacent other door, keeper means carried by said central bar adjacent each end thereof and cooperating with the respective outer and inner slidable bars for retaining said slidable bars in position alongside the upper and lower side surfaces of said central bar while permitting longitudinal sliding movement thereof, means carried by said central bar adjacent the inside end thereof for receiving and lockingly engaging with the extended free end portion of the inner sliding bar on the opposite door so that said pair of locking bar assemblies, when in the extended locked position, interlockingly engage one another at the opposing inside edges of the doors where the doors meet and also engage the door jambs along the outside edges of the doors to thereby maintain the pair of double doors in tightly locked position, and means on each locking bar assembly for permitting securing the same in the extended locked position.

* * * * *